United States Patent [19]

Morrow, Sr. et al.

[11] 4,381,060

[45] Apr. 26, 1983

[54] RING SUPPORTED MOBILE TOWER CRANE

[75] Inventors: James G. Morrow, Sr.; Michael C. Anderson, both of Manitowoc, Wis.

[73] Assignee: The Manitowoc Company, Inc., Manitowoc, Wis.

[21] Appl. No.: 167,054

[22] Filed: Jul. 9, 1980

[51] Int. Cl.[3] ..... B66C 23/00

[52] U.S. Cl. ..... 212/195; 212/183; 212/239

[58] Field of Search ..... 212/179, 183, 184, 195, 212/245-248, 266-269, 222, 239, 233, 188, 178

[56] References Cited

U.S. PATENT DOCUMENTS

| | | | |
|---|---|---|---|
| 3,868,022 | 2/1975 | Greenlay et al. | 212/195 |
| 3,878,944 | 4/1975 | Beduhn et al. | 212/196 X |
| 4,042,115 | 8/1977 | Beduhn et al. | 212/178 |
| 4,159,776 | 7/1979 | Holter | 212/239 |
| 4,194,638 | 3/1980 | Morrow, Sr. et al. | 212/239 |
| 4,195,740 | 4/1980 | Beduhn et al. | 212/239 X |

*Primary Examiner*—Andres Kashnikow
*Assistant Examiner*—L. E. Williams
*Attorney, Agent, or Firm*—Leydig, Voit, Osann, Mayer & Holt, Ltd.

[57] ABSTRACT

A ring supported mobile lift crane includes a load carrier and a counterweight carrier in riding contact with the ring and a tower mounted on the carrier for pivotal movement between generally horizontal and vertical positions with a boom pivoted to the outer end of the tower and a rearwardly inclined mast mounted on said carrier and connected to the counterweight carrier by rigging a mast pendant, a tower backstay connected to the top of the tower and through tower hoist rigging to the top of the mast. A fixed boom strut is connected at one end to the top of the tower and at the other end to a fixed pendant secured to the carrier and a movable boom strut is connected at one end to the top of the tower and at the other end to a fixed pendant secured to the outer end of the boom, with a multi-part boom hoist line interconnecting the outer ends of the fixed and movable boom struts for raising and lowering the boom, and a tower erection hoist for changing the length of the tower hoist rigging for raising and lowering the tower, boom, boom struts and tower backstay as a unit.

8 Claims, 2 Drawing Figures

RING SUPPORTED MOBILE TOWER CRANE

The present invention relates generally to high capacity lift cranes and more particularly concerns a self-erecting tower crane rotatably mounted on a large mobile ring.

BACKGROUND OF THE INVENTION

In recent years, heavy lift cranes have been made capable of lifting ever greater loads at increased heights and lifting radii. Also, the question of economy is always present and with larger, inherently more expensive devices, the need for additional equipment to assist in erection and disassembly and the tyeing up of the apparatus in a configuration which is not fully utilized becomes increasingly costly.

While a number of factors enter into determining crane capacity, a basic limitation arises from the fact that, inevitably, the weight of the crane and its load must be transferred to the earth in some stable fashion and, if rotation of the load is desired, the crane-earth connection must be made stable through the arc of crane rotation.

A significant increase in crane capacity was achieved by providing a self-propelled crane with the support ring and extended boom carrier disclosed and claimed in U.S. Pat. Nos. 3,485,383; 3,878,944 and 4,194,638 assigned to the assignee of the present invention. In the design disclosed in these patents, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

Further refinements in ring supported cranes are disclosed in U.S. Pat. Nos. 4,042,115, 4,103,783 and 4,195,740 as well as in copending application Ser. Nos. 058,284 and 058,285, both filed July 17, 1979, now abandoned; and all of which are assigned to the assignee of the present invention. These patents and applications disclose inter alia that a separate transporter mechanism may be run in and out of an otherwise stationary ring supported crane in order to move that crane between different locations or job sites, that the ring may be mounted on a support frame on a single transporter or the ring may be mounted on fore and aft transporter mechanisms to support the heavy boom and counterweight loads.

SUMMARY OF THE INVENTION

It is the primary aim of the present invention to provide a ring supported mobile lift crane with a load carrier and a counterweight carrier in riding contact with the ring, and including a tower mounted on the carrier for pivotal movement between generally horizontal and vertical positions, a boom pivoted to the outer end of the tower, a rearwardly inclined mast mounted on the carrier and connected to the counterweight carrier by rigging means, a tower backstay connected to the top of the tower and through tower hoist rigging to the top of the mast, a fixed boom strut connected at one end to the top of the tower and at the other end to a fixed pendant secured to the carrier, a movable boom strut connected at one end to the top of the tower and at the other end to a fixed pendant secured to the outer end of the boom, a boom hoist line interconnecting the outer ends of the fixed and movable boom struts for raising and lowering the boom, and means for changing the length of the tower hoist rigging for raising and lowering the tower, boom, boom struts and tower backstay as a unit.

These and other objects and advantages of the invention will become apparent upon reading the following detailed description and upon reference to the drawings, in which:

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

DESCRIPTION OF THE PREFERRED EMBODIMENT

Figure 1:
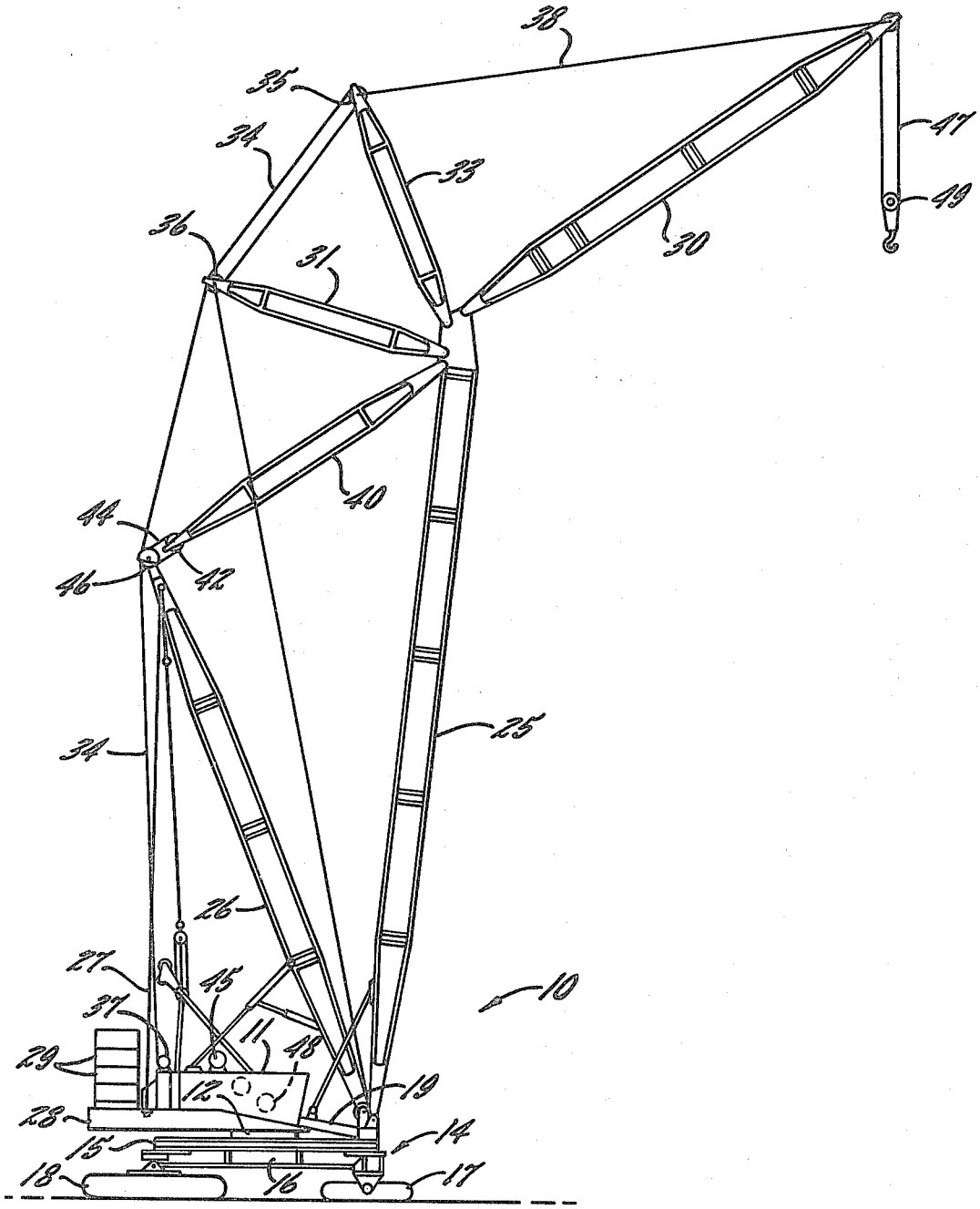
FIG. 1 is a side elevation of a self-erecting tower lift crane rotatably mounted on a large mobile ring embodying the features of the present invention.

Turning now to the drawings, there is shown in FIG. 1 a crane 10 having an upper structure 11 mounted for rotation on a turntable 12 carried by lower works 14. In order to increase the capacity of the crane 10, a track-like ring 15 surrounds the turntable 12 and is supported by beams 16 secured to front and rear transporter means 17 and 18. Preferably, the ring 15 has an I-beam cross section with a hardened upper path surface.

For rotating the upper works 11, a plurality of swing drive motors (not shown) are provided. Preferably, the swing drive motors are hydraulically activated and the drive gears are held in constant engagement with teeth formed on the inner periphery of the ring 15 in the manner taught by U.S. Pat. No. 4,013,174, also owned by applicants' assignee, and the disclosure of which is incorporated herein by reference. The geometry of the crane 10 contributes to its high capacities when used with the ring support. A carrier 19 is pivoted for vertical movement on the upper structure 11 and provided with a roller assembly (not shown) for rotation on the ring 15.

In the preferred embodiment, a tower 25 is pivotally mounted on the carrier 19 which also mounts an upwardly and rearwardly inclined mast 26. A mast pendant 27 interconnects the upper end of the mast 26 and a counterweight support 28 on which items of counterweight 29 are located. Pivotally mounted at the upper end of the tower 25 is a load handling boom 30. A boom strut 31 is also mounted on the top of the tower 25 and projects upwardly and rearwardly therefrom. The boom strut 31 is held in fixed position by a pendant 32 connected to the upper end of the boom strut 31 and connected to the carrier 19. Thus it will be seen that the tower 25, boom strut 31 and pendant 32 form a fixed triangle.

A movable boom strut 33 is also pivotally mounted to the top of the tower 25 and is connected to the tip of the boom 30 by a fixed pendant 38 thus forming another triangular structure. To raise and lower the boom 30, a multipart boom hoist line 34 has one end connected to the end of the fixed boom strut 31, passes around a sheave 35 on the end of the movable boom strut 33, around a guide sheave 36 on the end of the fixed boom strut 31, and then down to a boom hoist drum 37 mounted on the crane upper works 11. Preferably, the boom hoist drum 37 is hydraulically driven as taught in U.S. Pat. No. 4,136,855 which is owned by applicants' assignee and the disclosure of which is incorporated herein by reference. It will be understood that as wire rope 34 is payed out from the hoist drum 37, the boom 30 is lowered and that reeving in the wire rope 34 raises the boom.

Pursuant to the invention, a tower backstay 40 is connected to the top of the tower 25 and extends rearwardly to an equalizer assembly 42 connected to the top of the mast 26. In accordance with one aspect of the invention, the tower 25, boom 30, boom struts 31, 33 and tower backstay 40 may be erected and lowered as a unit.

For raising and lowering the tower 25, boom 30 and associated struts 31, 33 and tower backstay 40, a wire rope 44 is wound on a drum of a hoist mechanism 45 mounted on the crane 10 and is reeved over a sheave 46 adjacent the top of the mast 26 which forms part of the equalizer assembly 42.

Figure 2:
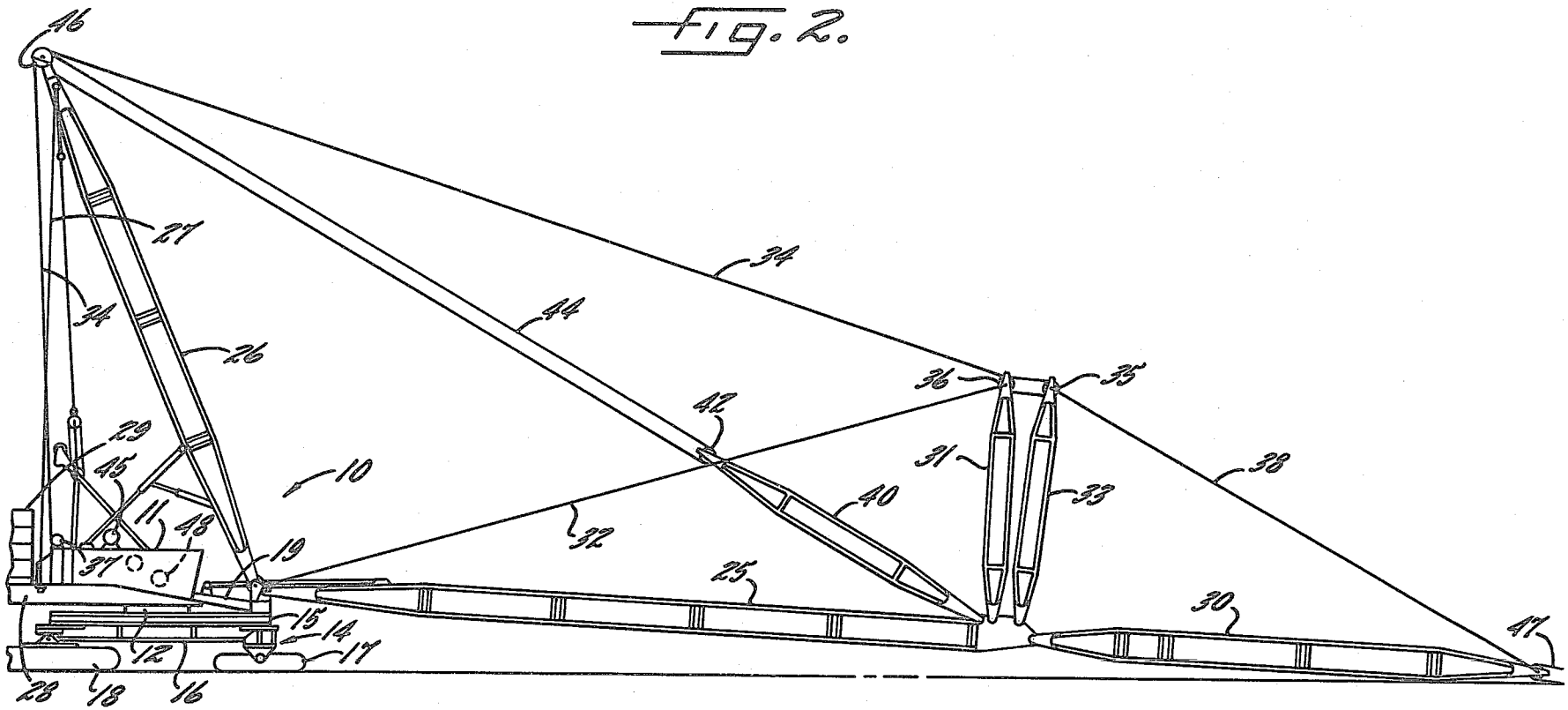
FIG. 2 is a side elevation of the lift crane of FIG. 1 with the tower and boom lowered to a horizontal position prior to erection or dismantling thereof.

Turning now to FIG. 2, the tower 25 and boom 30 of the crane 10 are shown in the initial stages of being erected. It will be understood that the tower 25 can be lowered further to rest on the ground or suitable blocking prior to assembly of the boom 30, boom struts 31, 33 and tower backstay 40 as well as rigging the wire rope 34 for the boom hoist 37, wire rope 44 for the tower erection hoist 45 and a wire rope 47 which is wound on the main hoist mechanism 48 and carries the load handling hook block 49 at the end of the boom 30.

As the wire rope 44 is reeved in, the tower 25 is raised from its ground supported position. Continuing to reeve in wire rope 44, raises the tower higher and also begins to raise the boom 30 as well, provided that the boom hoist line 34 is taut. It will be understood that the boom 30 may be disposed at a greater angle with respect to the tower 25 than is shown in FIGS. 1 and 2, but that it cannot be pulled back over center due to the boom strut 31.

While only a single tower of the 25 is shown, the crane 10 may have twin towers 25 pivotally mounted in laterally spaced relation on the forward carriers 19, and twin booms 30.

Pursuant to the present invention, traveling support means 17 and 18 are provided for supporting the ring 15 to permit movement of the crane 10 and ring 15 over the ground while the boom is lifting a heavy load. In the preferred embodiment the traveling support means 17 and 18 each include a pair of laterally spaced crawler assemblies respectively located adjacent the forward ends of the support beams 16, such as disclosed in copending U.S. application Ser. No. 058,284, abandoned which is incorporated herein by reference. Each of the tracks of the crawler assemblies 17, 18 may be independently powered to move the crane 10 under load by selectively and reversibly powering the crawlers such as by independent fixed and variable displacement hydraulic motors as shown in U.S. Pat. No. 4,000,784, which is also incorporated herein by reference.

We claim as our invention:

1. A ring supported mobile lift crane comprising in combination, lower works including a supporting frame and self-propelled transport means, a ring defining track mounted on said frame and transport means, upper works mounted above said frame for rotation with respect thereto, a load carrier extending from said upper works in riding contact on said ring, a counterweight carrier extending oppositely from said upper works in riding contact with said ring, a tower mounted on said load carrier for pivotal movement between generally horizontal and vertical positions, a boom pivoted to the outer end of said tower, a rearwardly inclined mast mounted on said load carrier and connected to said upper works and said counterweight carrier by rigging means, a tower backstay connected to the top of said tower and through tower hoist rigging to the top of said mast, a fixed boom strut connected at one end to the top of said tower and at the other end to a first fixed pendant secured to said load carrier so that said tower, said fixed boom strut and said first fixed pendant form a first fixed triangle, a movable boom strut connected at one end to the top of said tower and at the other end to a second fixed pendant secured to the outer end of said boom so that said boom, said movable boom strut and said second fixed pendant form a second fixed triangle, means including a boom hoist line interconnecting the outer ends of said fixed and movable boom struts for raising and lowering said boom, and means for changing the length of said tower hoist rigging for raising and lowering said tower, boom, boom struts and tower backstay as a unit.

2. The crane defined in claim 1 wherein said self-propelled transport means includes fore and aft pairs of crawler tracks under said ring.

3. The crane defined in claim 1 wherein means are provided for pin connecting said tower backstay to the top of said mast.

4. The crane defined in claim 1 including means for rotating said boom carrier and counterweight carrier on said ring.

5. The crane defined in claim 1 including tower stop means for preventing raising said tower over center.

6. The crane defined in claim 1 including mast stop means for limiting the rearward angle of said mast.

7. The crane defined in claim 1 including a gantry mechanism mounted on said upper works and an adjustable linkage from said gantry to the top of said mast.

8. The crane defined in claim 1 wherein said tower, boom, struts and backstay are formed of open lattice type members.

* * * * *